United States Patent [19]

Meadows

[11] Patent Number: 4,792,802

[45] Date of Patent: Dec. 20, 1988

[54] TELEMETRY SYSTEM FOR BOREHOLE DRILLING

[75] Inventor: Alan Meadows, Stretton, England

[73] Assignee: Coal Industry (Patents) Limited, London, England

[21] Appl. No.: 46,114

[22] Filed: May 5, 1987

[30] Foreign Application Priority Data

May 16, 1986 [GB] United Kingdom ..... 8612008

[51] Int. Cl.[4] ..... G01V 1/00

[52] U.S. Cl. ..... 340/856; 340/857; 174/47

[58] Field of Search ..... 367/76, 81; 340/853, 340/856, 857; 174/69, 70 R, 47

[56] References Cited

U.S. PATENT DOCUMENTS

| | | | |
|---|---|---|---|
| 3,904,840 | 9/1975 | Kostelnicek | 340/856 |
| 4,276,333 | 6/1981 | Cobean | 156/195 |
| 4,319,240 | 3/1982 | Stone et al. | 340/856 |
| 4,325,438 | 4/1982 | Zuvela | 175/50 |

FOREIGN PATENT DOCUMENTS 1557863 12/1979 United Kingdom .

OTHER PUBLICATIONS

"Expendable Wire Links", *Book of Preprints*, Marine Technology Soc., 7th Annual Conference, ©1971 by H. C. Hottel, Jr.

*Primary Examiner*—Charles T. Jordan
*Assistant Examiner*—John W. Eldred
*Attorney, Agent, or Firm*—James C. Wray

[57] ABSTRACT

A telemetry system for borehole drilling comprises an effectively continuous length of hardwire cable which extends along a drill string located in a borehole between electrical signal control, indication equipment situated outside the borehole and probe means situated within the borehole. The effective continuous length of hardwire includes a store of hardwire constituted by a bonded wound hollow coil of hardwire located adjacent the probe means.

9 Claims, 4 Drawing Sheets

TELEMETRY SYSTEM FOR BOREHOLE DRILLING

This invention relates to a telemetry system for borehole drilling, the telemetry system being used to convey electrical signals along the borehole between probe means located in the borehole and signal control equipment situated outside the borehole. In addition or alternatively, instruction signals may be fed from the signal control equipment situated outside the borehole to receiving equipment in the probe means located within the borehole.

In this specification the nature of the signals transmitted between the probe means and the signal control equipment may have a variety of functions including control and monitoring functions.

It is known from prior telemetry systems to feed a continuous hardwire for transmitting electrical signals from a store situated at the mouth of the borehole, or within a drill pipe section adjacent the mouth of the borehole, along the central aperture defined by a series of hollow drill pipe sections to equipment at or in the borehole. Although such a system tends to give efficient signal transmission it suffers from the disadvantage that the hardwire store has to be threaded through new drill pipe sections added to the drill string as the borehole is extended. Also, the hardwire has to be unthreaded from each drill pipe section when the drill string is removed from the borehole. In an attempt to avoid the need repeatedly to thread and unthread the store of hardwire as the drill string is extended or withdrawn from the borehole, it is known initially to thread the hardwire through all the drill pipe sections stacked at the mouth of the borehole ready for use. Unfortunately, this proposal receives an involved operational procedure to ensure the drill pipe sections are fed onto the drill string in the correct order and that the loose lengths of hardware extending between the sections do not become trapped or damaged.

A further known proposal involves the use of a sheave of stored hardwire located axially within a section of the drill string installed within the borehole. Although this proposal substantially overcomes the problems associated with the need to thread or unthread the hardwire through the drill pipe sections it introduces a further problem in that the axially located sheath tended to restrict the flow of drilling fluid along the drill string and therefore interferes with the drilling operations.

An object of the present invention is to provide an improved hardware telemetry system for borehole drilling which enables information signal means to be transmitted efficiently along the drill string and which tends to overcome or reduce the above mentioned problems.

According to the present invention a telemetry system for borehole drilling comprises an effectively continuous length of hardwire which in use extends along a drill string located in a borehole, the hardwire extending between electrical signal control equipment situated outside the borehole and probe means situated within the borehole, the effectively continuous length of hardwire including a store of hardwire constituted by a bonded wound hollow coil of hardwire situated adjacent to the probe means.

Advantageously, the store of hardwire comprises a wound hollow coil having a plurality of layers.

Advantageously, the hardwire comprises a twin core cable.

Preferably, each turn of cable within the wound hollow coil is lightly bonded only to adjacent turns in the same layer.

Preferably, the bond is achieved by using an adhesive which is a solvent for the outer insulation of the cable and which thereby, tends to weld together adjacent turns.

Preferably, adhesion between layers is prevented by using a coating, such as a silicone oil, provided between the layers.

Advantageously, the wound hollow coil is bonded to the inside wall of the drill pipe section.

Conveniently, the store of hardwire may comprise a plurality of wound hollow coils spliced end to end. The splicing may be by means of a connection including a hollow sealed tube enclosing the joined ends of coils and filled with an electrically insulating grease.

By way of example, only, one embodiment of the present invention now will be described with reference to the accompanying drawings, in which.

Figure 1:
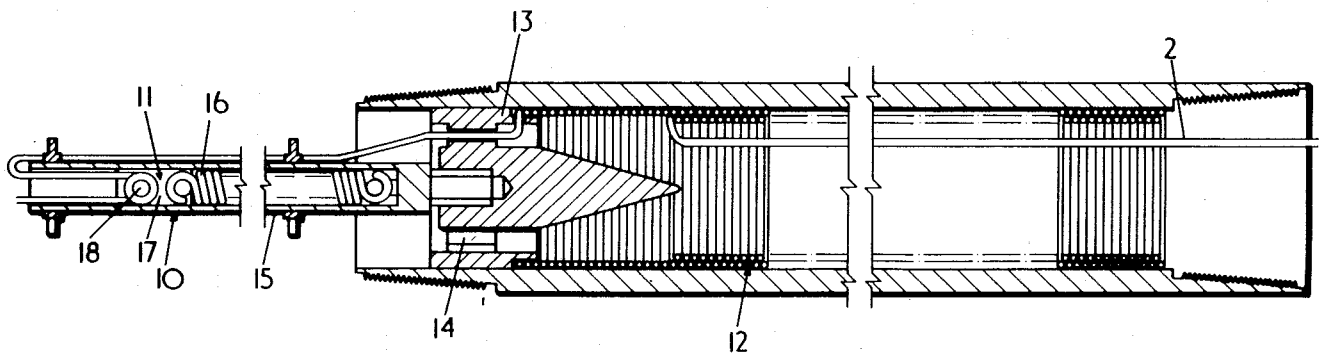
FIG. 1 is a diagrammatic longitudinal sectional view taken through a drill pipe section provided with a store of hardwire in the form of a wound, hollow coil.
Figure 2:
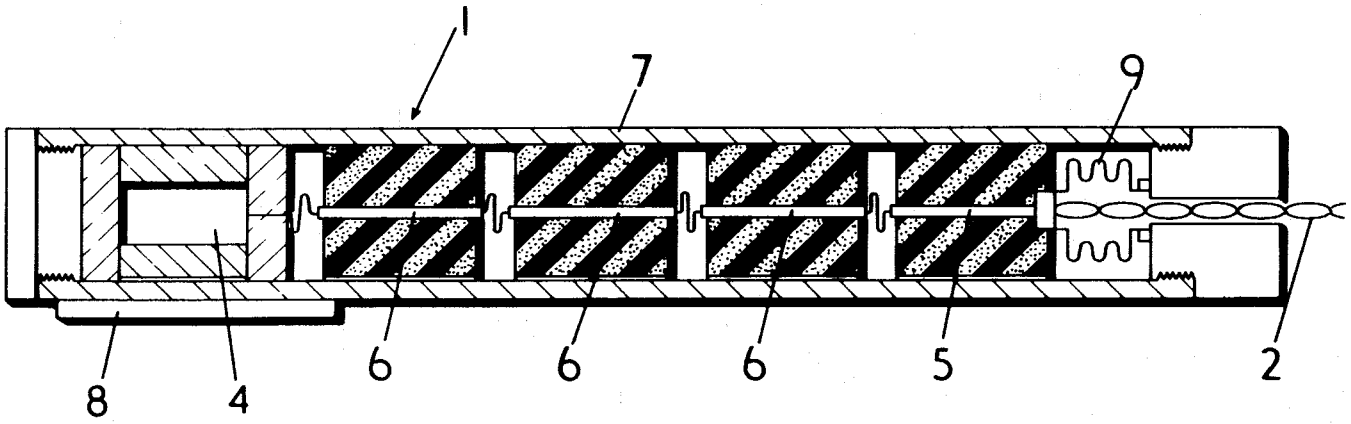
FIG. 2 is a diagrammatic longitudinal sectional view taken through one embodiment of borehole probe means.

The accompanying figures show details of a telemetry system for borehole drilling which enables electrical signals to be transmitted from borehole probe means 1 along a hardwire 2 constituted by an insulated twin wire and via a slip ring unit 3 to signal control equipment (not shown) located outside the mouth of the borehole. The borehole probe means 1, comprises, in this example, a crystal-photomultiplier assembly 4, an inclination sensor 5 and various electronic circuit means 6, is housed within a tubular housing 7 which in turn is housed within a drill pipe section (not shown). A metal shield 8 is provided partially to enclose the crystal-photomultiplier assembly 4 to define window means opposite the shield and provide a directional view facility. The assembly 4, inclinometer means 5 and circuit means 6 are enclosed in protective coats of a foam plastic material to provide shock protection. A bellows arrangement 9 retains the various component linearly. The electrical signals derived by the probe means 1 are fed back along the borehole by the hardwire telemetry system.

A head of the probe means 1 is a down-the-hole motor (not shown) arranged to drive a drill bit head (not shown). Behind the probe means 1 the hardwire 2 is fed to a tensioning means 10 which ensures the length of hardwire 2 between the probe means and the tensioning means is always maintained tight. The tensioning means include a spring biassed pulley arrangement 11 which permits an extra length of hardwire to be fed out when the drill pipe section provided with the tensioning means in disconnected from the drill pipe section including the probe means. Moreover, the tensioning means ensures the hardwire is maintained taught during the connection of two drill pipe sections thereby ensuring the hardwire does not become trapped in the screw joint between the sections during the connecting operation.

FIG. 1 shows how the hardwire is fed from a store of hardwire constituted by a wound hollow coil 12 and, via a collar arrangement 13 having radial arms 14 supporting the tensioning means, to the tensioning means 10, the tensioning means includes a central cylindrical slideway 15 housing a tension spring 16 and a piston 17 carrying a pulley 18 of the aforementioned pulley arrangement 11. The hardwire leaving the coil 12 extends to a radially outer collar of the collar arrangement 13 and then is passed along one of the radial arms 14 to the tensioning means where it is looped over the forward end of the cylindrical slideway 15 and around the pulley 18 to provide a take up loop.

Figure 4:
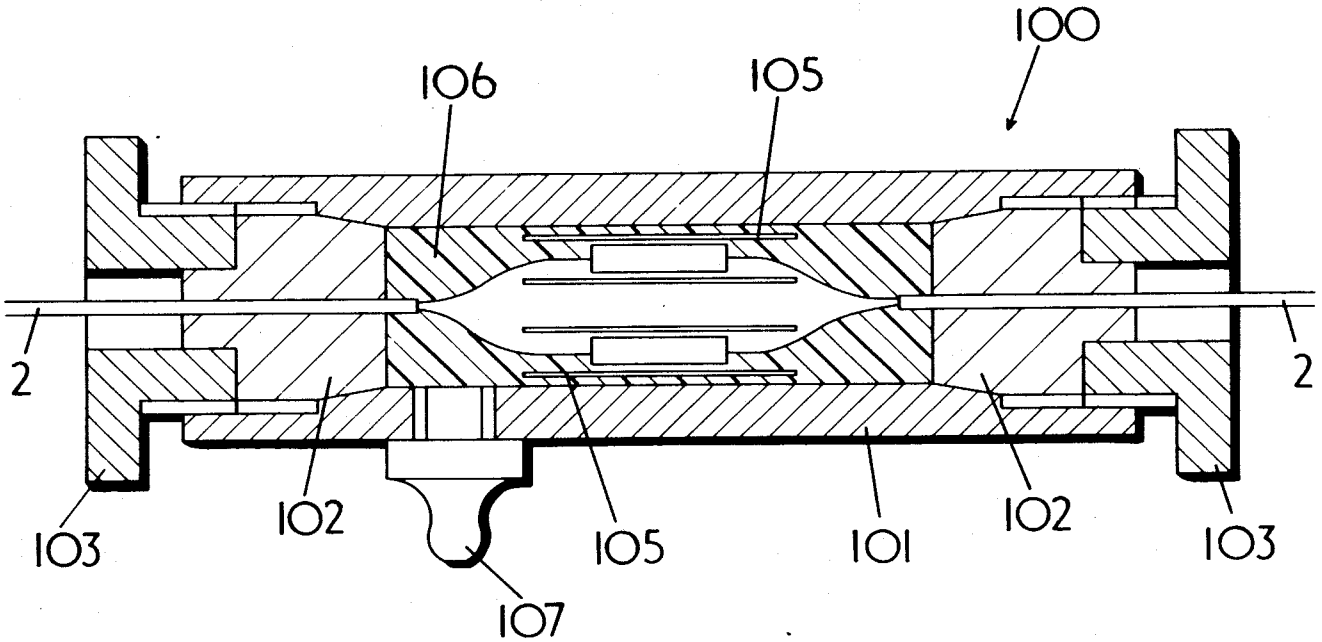
FIG. 4 is a diagrammatic longitudinal sectional view taken through a connector for splicing together lengths of hardwire.

The wound hollow coil 12 providing the store of hardwire is situated adjacent to the probe means and comprises a double layer of wound turns. The double layers are wound in opposite directions to minimise inductance and the hardwire comprises a twin core insulated cable. Each turn of cable of the wound hollow coil is lightly bonded to adjacent turns in the same layer, the bond being achieved by using an adhesive which is a solvent for the outer insulation of the cable and which thereby tends to weld together adjacent turns. Adhesion between turns in different layers is prevented by coating the wound layer with, for example, silicone oil. The hollow coil 12 is bonded inside the drill pipe section. If a larger capacity store of cable is required then more than one hollow coil can be used. The lengths of hardwire in the plurality of coils are spliced together by a connector 100 as shown in FIG. 4. Each connector comprises a plastic tube 101 having its ends sealed by resilient grommets 102 secured in position by lock nuts 103. The cores of twin hardwire are connected by crimping or twisting their free ends and located in an electrically insulating sleeve 105. A connecting chamber 106 is then filled with silicone grease through a grease nipple 107 which is removed after filling and replaced by a plug. The connector 100 provides a sealed water proof splice connecting together two lengths of hardwire 2.

From FIG. 1 it can be seen that the wound hollow coil of cable leaves the centre of the drill pipe open and the coil thereby tends not to lock the pipe and does not tend to restrict flow of drilling fluid along the pipe.

Figure 3:
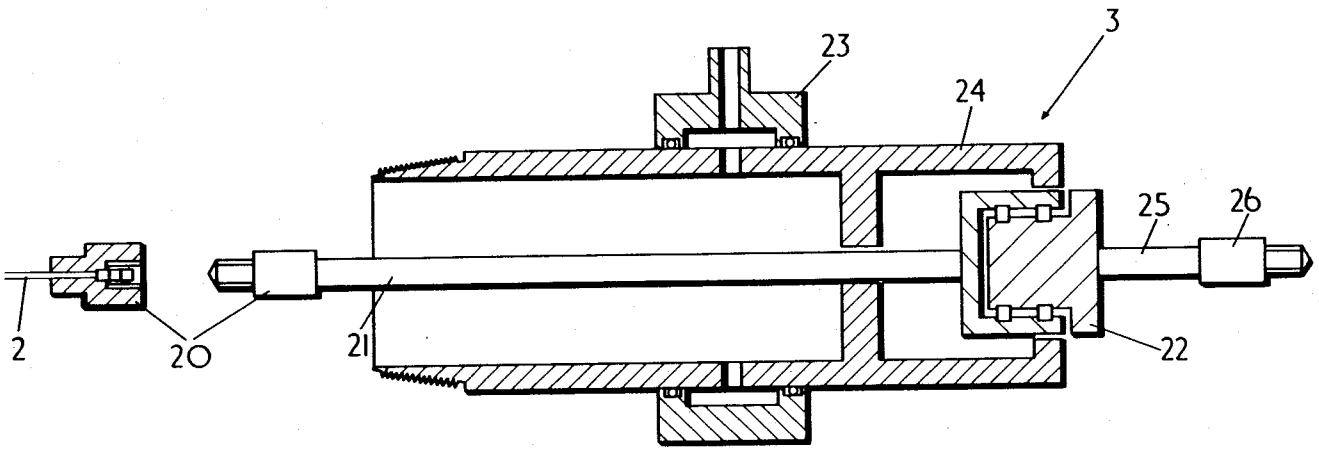
FIG. 3 is a diagrammatic longitudinal sectional view taken through a slip ring unit for mounting on a drill string adjacent to the mouth of a borehole.

The cable from the hollow coil 12 passes along the drill string towards the mouth of borehole where it is disconnectably connected to a connector 20 (shown in FIG. 3 disconnected) provided on the forward end of a shaft 21 supported by the aforementioned slip ring unit 3 including a slip ring device 22 and a drilling fluid inlet adaptor 23 sealably mounted on a cylindrical housing 24. A further shaft 25 extending from the slip ring device 22 is provided with a further connector 26 enabling a further length of cable (not shown) to feed electrical signal means to signal control equipment (not shown) situated outside the borehole.

When the drill string has to be extended the slip ring unit 3 is disconnected from the last installed drill pipe section and the cable disconnected from the connector 20. After removal of the slip ring unit 3 a new drill pipe section is fed towards the mouth of the borehole and the end of the cable previously connected to the connector 20 is threaded through the pipe section before the section is connected to the drill string. The cable then is reconnected to the connector 20 and the slip ring unit 3 remounted on the end of the extended drill string. Drilling then can continue until a further drill pipe section is required. The above extention procedure then is repeated. A similar disconnection and reconnection procedure is followed when the drill string is withdrawn from the borehole to facilitate threading, a semi-stiff rod (not shown) is used which can be pushed up inside the new pipe section of the drill string. This is fitted with a dummy connector at the end which mates with the connector terminating the telemetry cable. When the new rod is mounted on the machine prior to assembly into the string the telemetry cable can then be conveniently pulled through.

It will be appreciated that throughout the drilling operation the efficient, effective continuous hardwire telemetry system is maintained so that signals can be transmitted from the probe means to signal control, monitory and or indication equipment mounted outside the borehole. Also control signals may be efficiently transmitted along the hardwire from control equipment situated outside the borehole to controlled equipment located within the borehole. Such controlled equipment may comprise, for example, steering equipment for the bit of the drill string.

In other installations a flat 'figure of eight' cross-section twin core cable may be replaced by a single core cable, the pipes of the drill string being used as an electrical signal return path. Alternatively, cables with more than two cores can be used. As a further alternative optical fibre cables may be used.

When feeding power supply to power a probe it may be preferred to maintain the total electrical resistance of the circuit substantially constant, when a plurality of coils are used a set of switched resistances might be included in the telemetry circuit.

I claim:

1. A telemetry system for borehole drilling comprising an effectively continuous length of hardwire arranged to extend along a drill string located in a borehole electrical signal control equipment being situated outside the borehole and probe means being situated within the borehole, the hardwire extending between the electrical signal control means and the probe means, the effectively continuous length of hardwire including a store of hardwire constituted by a wound hollow coil of hardwire situated adjacent to the probe means, and wherein the coil is bonded to the inside wall of the drill pipe section.

2. A telemetry system as claimed in claim 1, in which the hardwire comprises a twin core cable.

3. A telemetry system as claimed in claim 1, in which each turn of hardwire within the wound hollow coil is lightly bonded only to adjacent turns of the same layer.

4. A telemetry system as claimed in claim 1, in which the bond is achieved by using an adhesive which is a solvent for an outer insulation of the cable and which thereby, tends to weld together adjacent turns.

5. A telemetry system as claimed in claim 1, in which the store of hardwire comprises a wound hollow coil having a plurality of layers of hardwire.

6. A telemetry system as claimed in claim 1, in which adhesion between layers is prevented by using a coating provided between the layers.

7. A telemetry system as claimed in claim 6 in which the coating is of silicone oil.

8. A telemetry system as claimed in claim 1, in which the wound hollow coil is retained inside a drill pipe section.

9. A telemetry system as claimed in claim 1, in which the store of hardwire comprises a plurality of wound hollow coils spliced end to end.

* * * * *